US012478863B2

(12) United States Patent
Jiang

(10) Patent No.: US 12,478,863 B2
(45) Date of Patent: Nov. 25, 2025

(54) SENSING DEVICE, BALL SHAFT FOR SMART MAGIC CUBE, AND SMART MAGIC CUBE

(71) Applicant: GANCUBE LTD., Guangdong (CN)

(72) Inventor: Ganyuan Jiang, Guangzhou (CN)

(73) Assignee: GANCUBE LTD., Guangdong (CN)

( * ) Notice: Subject to any disclaimer, the term of this patent is extended or adjusted under 35 U.S.C. 154(b) by 251 days.

(21) Appl. No.: 18/333,556

(22) Filed: Jun. 13, 2023

(65) Prior Publication Data

US 2024/0269543 A1 Aug. 15, 2024

(30) Foreign Application Priority Data

Feb. 10, 2023 (CN) ..... 202310111195.6

(51) Int. Cl.
*A63F 9/08* (2006.01)
*A63F 9/34* (2006.01)
*A63F 9/24* (2006.01)

(52) U.S. Cl.
CPC ..... *A63F 9/0842* (2013.01); *A63F 9/34* (2013.01); *A63F 2009/0846* (2013.01); *A63F 2009/2442* (2013.01); *A63F 2009/2494* (2013.01)

(58) Field of Classification Search
CPC .. A63F 9/0842; A63F 9/34; A63F 2009/0846; A63F 2009/2442; A63F 2009/2494; A63F 9/0612; A63F 2009/2447; A63F 2009/2489; A63F 2009/2488; Y02E 60/10; G01B 7/30; G01B 7/00
USPC ..... 273/153 R
See application file for complete search history.

(56) References Cited

U.S. PATENT DOCUMENTS

| | | | | |
|---|---|---|---|---|
| 11,077,359 | B1 * | 8/2021 | Wigh | A63F 9/0842 |
| 11,311,795 | B1 * | 4/2022 | Lee | A63F 9/0842 |
| 2018/0311566 | A1 * | 11/2018 | Shin | A63F 9/24 |
| 2019/0091559 | A1 * | 3/2019 | Fu | G06F 3/03 |
| 2019/0184275 | A1 * | 6/2019 | Su | A63F 9/0834 |
| 2019/0374849 | A1 * | 12/2019 | Limaye | A63F 9/0612 |
| 2020/0009451 | A1 * | 1/2020 | Dor | A63F 13/35 |
| 2022/0143492 | A1 * | 5/2022 | Lee | A63F 9/24 |
| 2022/0241679 | A1 * | 8/2022 | Cornia | A63F 3/00214 |
| 2023/0191240 | A1 * | 6/2023 | Limaye | A63F 9/0842 463/9 |
| 2023/0356066 | A1 * | 11/2023 | Mariani | A63F 9/0612 |

* cited by examiner

*Primary Examiner* — Michael C Grant
(74) *Attorney, Agent, or Firm* — MUNCY, GEISSLER, OLDS & LOWE, P.C.

(57) ABSTRACT

A sensing device, a ball shaft for smart magic cube, and a smart magic cube are provided. By optimizing the sensing device of the smart magic cube, only two circuit boards are needed to sense rotation states in six directions, thereby changing a current technology that requires setting PCB boards and sensors in each direction of the smart magic cube. The smart magic cube has a simple structure and is easy to assemble, which may reduce production costs.

14 Claims, 11 Drawing Sheets

SENSING DEVICE, BALL SHAFT FOR SMART MAGIC CUBE, AND SMART MAGIC CUBE

TECHNICAL FIELD

The subject matter herein generally relates to a field of educational toys, especially in relate to a smart magic cube whose rotation state capable of being detected, a ball shaft constituting the smart magic cube, and a sensing device arranged on the ball shaft.

BACKGROUND

A magic cube has become the most popular educational toy since it was invented. A smart magic cube, by setting a sensing device inside the mart magic cube, can sensitively capture and record a rotation state of each face of the smart magic cube. By a communication unit such as Bluetooth, the rotation state of the smart magic cube is sent to a smart terminal device, and a control command from the smart terminal device can be accepted to control the magic cube. The smart magic cube increases a playability and interest of the magic cube, therefore becoming a first choice for many magic cube lovers.

In order to sensitively capture the rotation state of each face of the smart magic cube, the smart magic cube provided by the prior art needs to arrange a printed circuit board (PCB) on each of six faces of the magic cube, and arrange sensors, such as the smart magic cube described in Chinese patent applications with publication numbers CN111643884A and CN113624116A previously applied by the applicant.

Although the smart magic cube provided by the prior art can detect a rotation angle of each face well, it has the following disadvantages.

(1) Most of smart sensors provided by the prior art use metal brush sensors. The metal brushes have wear problems and tightness problems of mutual cooperation, which affects a service life of the sensors and causes the sensors to fail after a long time of use.

Therefore, it is impossible to accurately sense the rotation angle of the corresponding face of the smart magic cube, resulting in sensor function failure and confusion. At the same time, a contact friction between the metal brushes also affects touch sense.

(2) For the smart magic cube provided by the prior art, each of the six faces of the smart magic cube needs to arrange a separate PCB and arrange sensors, at the same time, it is necessary to make adjacent faces of the smart magic cube perpendicular to each other during an installation process. It requires a high precision of each face, which leads to a complex structure of the entire smart magic cube, and a high difficulty in installation, and increases a cost of the smart magic cube, resulting in high prices for the smart magic cube. When getting the smart magic cube, users cannot disassemble the smart magic cube casually, because if the users cannot reassemble each face according to a corresponding precision, it will greatly affect a sensing accuracy and a sensitivity of the sensors of the smart magic cube, and affect a rotation feel at the same time, which causes difficulties for the users to maintain the smart magic cube, and reduces enthusiasm of the users, especially young users, to explore a structure of the smart magic cube.

SUMMARY

Aiming at the above-mentioned technical problems existing in current smart magic cube, the embodiments of the present disclosure provide a sensing device for smart magic cube. By improving a structure of the sensing device, there is no need to define PCB boards and metal brush sensors for each face of the smart magic cube, so that a structure of a ball shaft using the sensing device provided by the present disclosure is greatly simplified, and the structure of the smart magic cube using the ball shaft is greatly reduced. The embodiments of the present disclosure further provide the ball shaft for the smart magic cube, and the smart magic cube using the ball shaft.

A first embodiment of the present disclosure provides a sensing device for smart magic cube, including a master circuit board and a slave circuit board. The master circuit board defines a micro control unit, the master circuit board includes a first circuit board and a second circuit board, the first circuit board is arranged on a front side of the master circuit board, and the second circuit board is arranged on a reverse side of the master circuit board. A plane rectangular coordinate system is built by setting a center of the first circuit board as an origin, setting a positive direction of an X-axis as a first direction, setting a negative direction of the X-axis as a third direction, setting a positive direction of a Y-axis as a second direction, and setting a negative direction of the Y-axis as a fourth direction. A first electronic sensing element, a second electronic sensing element, a third electronic sensing element, and a fourth electronic sensing element are correspondingly arranged in each of the first direction, the second direction, the third direction, and the fourth direction. A fifth electronic sensing element is arranged in a central area of the second circuit board. Each of electronic sensing elements is in communication connection with the micro control unit, and a slave circuit board arranged on a preset plane parallel to the first circuit board. The preset plane and the second circuit board are separated on both sides of the first circuit board, and the slave circuit board defines a sixth electronic sensing element, and the sixth electronic sensing element is in communication connection with the micro control unit.

The sensing device in the embodiment of the present disclosure only needs two circuit boards including the master circuit board and the slave circuit board, and there is no need to accurately control an angular relationship between the two circuit boards during an assembly process. The electronic sensing elements are arranged on the surface of each of the circuit boards. For current level of process assembly and manufacturing, it is possible to install each electronic sensing element very quickly and accurately. Therefore, the sensing device in the present disclosure greatly simplifies the structure of the smart magic cube, and also simplifies the process of assembling the smart magic cube, which can improve an efficiency of producing the smart magic cube, thereby reducing a cost of the smart magic cube. At the same time, when the smart magic cube needs to be repaired, users can also manually disassemble the smart magic cube. When reassembling the smart magic cube, there is no need for complicated and precise angle adjustment steps, which is convenient for the users to repair or explore an internal structure of the smart magic cube.

Based on a same invention purpose, the embodiments of the present disclosure provide a ball shaft for smart magic cube, including a ball shaft housing, a battery, and a wireless communication module. A three-dimensional coordinate system is built by setting a spherical center of the ball shaft housing as an origin, setting a right rotating shaft in a positive direction of a first X-axis, setting a left rotating shaft in a negative direction of the first X-axis, setting a front rotating shaft in a negative direction of a first Y-axis, setting a rear rotating shaft in a positive direction of the first Y-axis, setting an upper rotating shaft in a positive direction of a first Z-axis, and setting a lower rotating shaft in a negative direction of the first Z-axis. A positioning module is arranged on each of rotating shafts, and a second accommodation space for accommodating the sensing device is set inside the ball shaft housing. The battery is arranged in a battery compartment. The wireless communication module is in communication connection with the micro control unit, and the micro control unit is in communication connection with an external terminal by the wireless communication module. As the sensing device recited in above embodiment, the first electronic sensing element corresponds to the right rotating shaft, the second electronic sensing element corresponds to the rear rotating shaft, the third electronic sensing element corresponds to the left rotating shaft, the fourth electronic sensing element corresponds to the front rotating shaft, the fifth electronic sensing element corresponds to the lower rotating shaft, and the sixth electronic sensing element corresponds to the upper rotating shaft.

The ball shaft for smart magic cube in the present disclosure has optimized the structure of the sensing device used in the ball shaft, so that process requirements for assembling the sensing device are greatly reduced, thereby improving the processing efficiency and reducing a production cost. At the same time, due to using electronic sensing elements to sense the positioning module installed in the rotating shaft, an induction between the positioning module and the electronic sensing elements is non-contact and will not cause wear and tear, and will not cause a failure problem of using the smart magic cube.

Based on the same invention purpose, the embodiments of the present disclosure provide a smart magic cube including the ball shaft as recited in above embodiments, six central blocks, eight corner blocks, and twelve edge blocks. Each of the rotating shafts defines one of the center blocks, one of the twelve edge blocks is arranged between every adjacent two of the central blocks, and one of the eight corner blocks is arranged between every adjacent three of the twelve edge blocks.

The smart magic cube provided in the present disclosure, by improving the structure of the ball shaft in a center position, greatly reduces the assembly process requirements of the ball shaft, does not need to accurately adjust the angle of the PCB on each face, and does not require a large number of spot welding, which not only increases a working stability of the smart magic cube, but also improves a production efficiency and reduces a production cost, thus improving a market competitiveness of the smart magic cube.

BRIEF DESCRIPTION OF THE DRAWINGS

In order to more clearly illustrate technical solutions in the embodiments of the present disclosure, the following will briefly introduce the drawings that need to be used in the description of the embodiments. Obviously, the drawings in the following description are some embodiments of the present disclosure. For those of ordinary skill in the art, on a premise of not paying creative work, other drawings can also be obtained according to these drawings.

Figure 1:
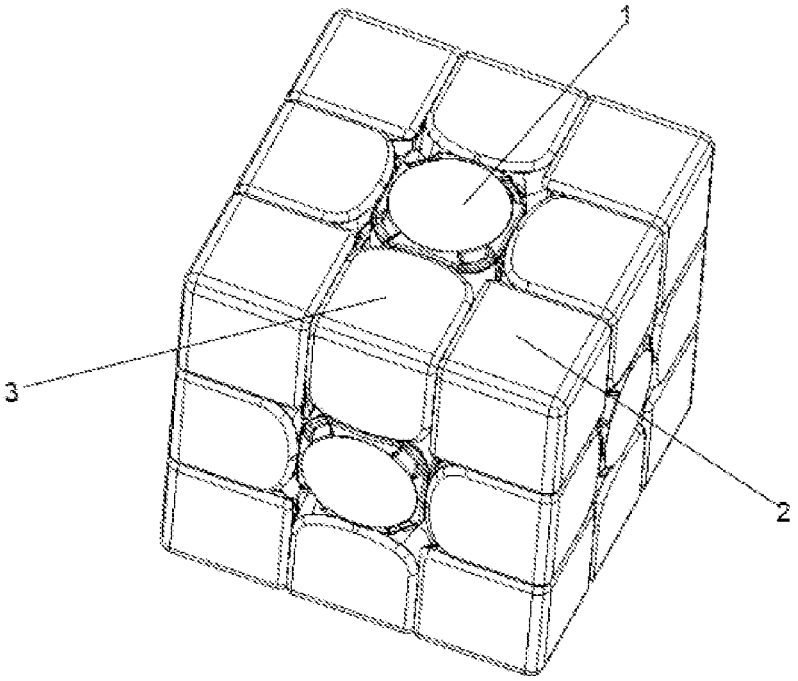
FIG. 1 is a structural schematic diagram of a smart magic cube according to one embodiment of the present disclosure.

Reference numerals in the drawings: 1. central blocks; 2: corner blocks; 3: edge blocks; 4: ball shaft; 41: ball shaft housing; 411: upper half housing; 412: lower half housing; 42: rotating shaft; 421: right rotating shaft; 422: left rotating shaft; 423: front rotating shaft; 424: rear rotating shaft; 425: upper rotating shaft; 426: lower rotating shaft; 44: second accommodation space; 45: battery compartment; 46: battery; 47: battery cover; 5: sensing device; 51: master circuit board; 511: first circuit board; 512: second circuit board; 52: slave circuit board; 522: long strip connection structure; 531: first electronic sensing element; 532: second electronic sensing element; 533: third electronic sensing element; 534: fourth electronic sensing element; 535: fifth electronic sensing element; 536: sixth electronic sensing element; 54: positioning module; 55: circuit board fixing base; 551: first fixing platform; 552: second fixing platform; 61: antenna; 62: antenna fixing base.

DETAILED DESCRIPTION

In order to make purposes, technical solutions and advantages of the present disclosure clearer, technical solutions of the present disclosure will be clearly and completely described by implementation with reference to the accompanying drawings in the embodiments of the present disclosure. Obviously, described embodiments are part of the embodiments of the present disclosure, but not all embodiments. Based on the embodiments of the present disclosure, all other embodiments obtained by persons of ordinary skill in the art without making creative efforts belong to a protection scope of the present disclosure.

In the description of the present disclosure, a "first" and a "second" described is only for a purpose of distinguishing technical features, it cannot be understood as indicating or implying relative importance or implicitly indicating a number of indicated technical features or implicitly indicating a sequence of the indicated technical features.

In the description of the present disclosure, unless otherwise clearly defined, words such as setting should be understood in a broad sense, and those skilled in the art can reasonably determine specific meanings of the above words in the present disclosure in combination with specific content of the technical solutions.

The inventor, as an engineer engaged in a research and development of the smart magic cube, provided various existing implementation schemes of the smart magic cube. Although the aforementioned implementation scheme of the smart magic cube can provide a product, the inventor also found that there are problems of complex structure in a process of assembling a large number of the aforementioned smart magic cube. At the same time, in a process of assembling the smart magic cube, required process is strict. In a process of connecting the PCB boards arranged on six faces, on the one hand, it is necessary to adjust the PCB boards to ensure that the PCB boards are perpendicular to each other, and at the same time, the connection between the PCB boards needs to be soldered, and solder joints are small and have a large quantity.

By carefully analyzing the existing problems of the current smart magic cubes, the inventor of the present disclosure creatively provides a technical solution of, thereby greatly simplifying a structure of the sensing device used for the smart magic cube. On the one hand, due to a large reduction in the use of the PCB boards, a cost of materials can be greatly reduced. On the other hand, a process complexity required for assembly is greatly reduced, an efficiency of assembling and processing the smart magic cube is improved, and a production cost is reduced.

Figure 2:
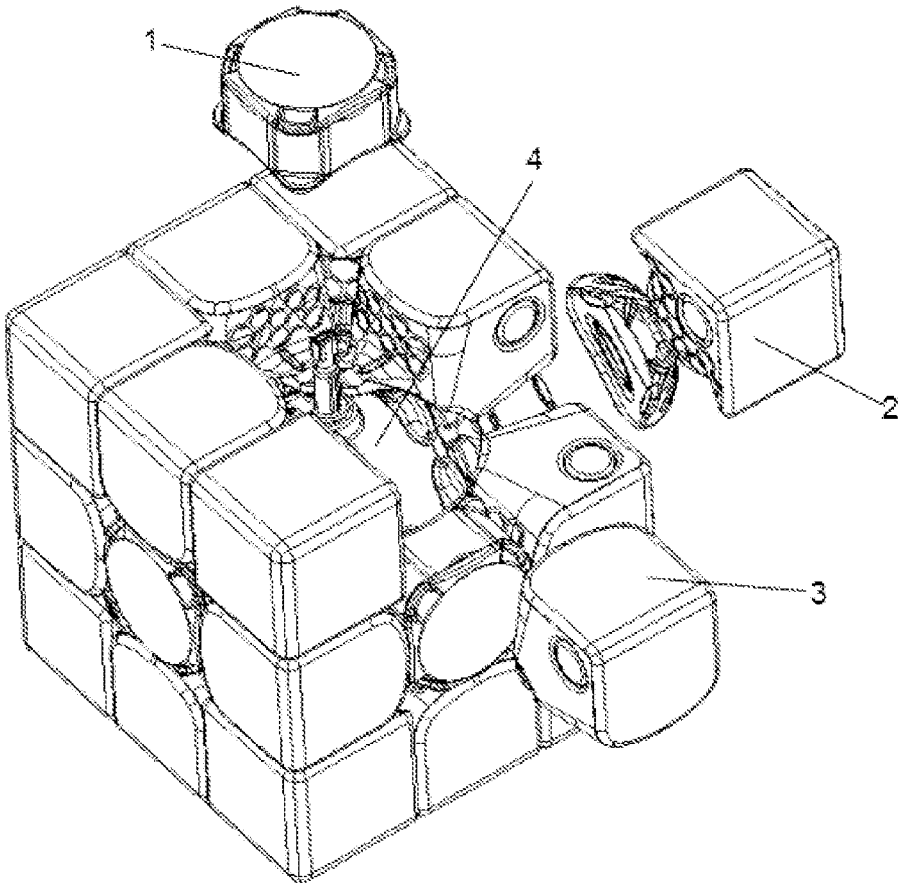
FIG. 2 is a structural schematic diagram of a first partly disassembled structure of the smart magic cube according to one embodiment of the present disclosure.
Figure 3:
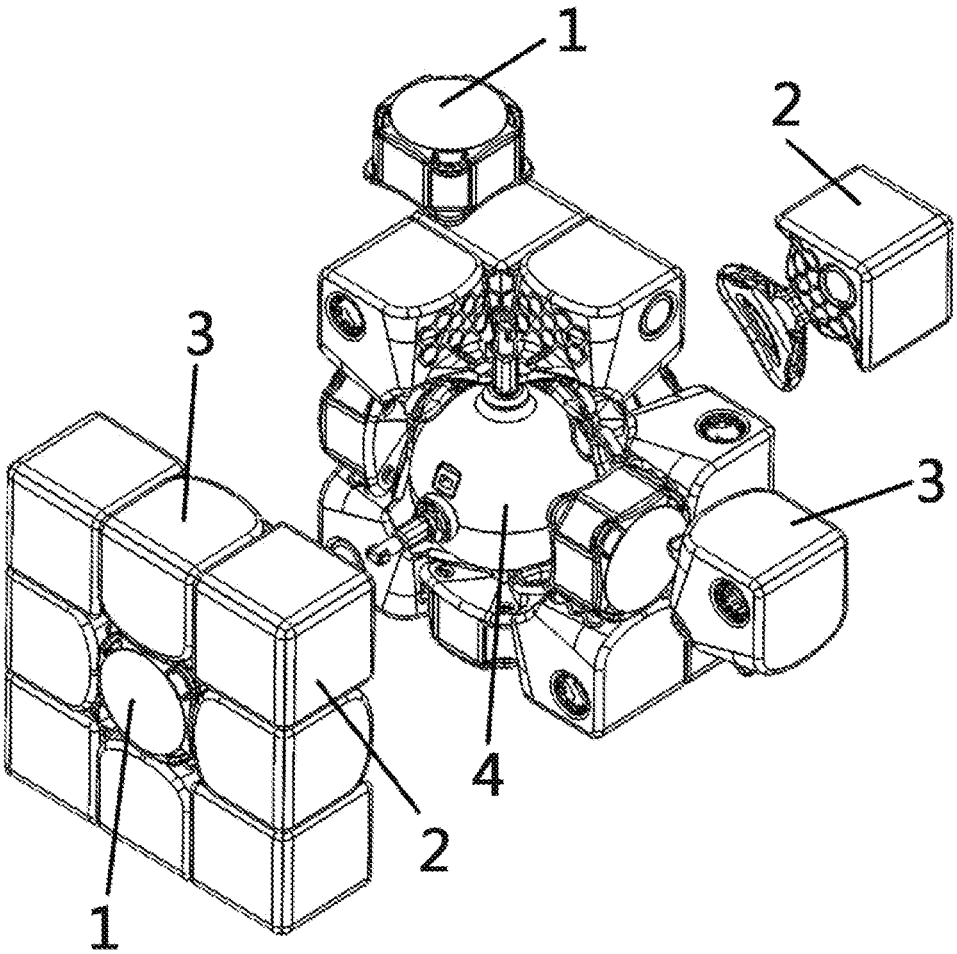
FIG. 3 is a structural schematic diagram of a second partly disassembled structure of the smart magic cube according to one embodiment of the present disclosure.

As shown in FIG. 1, FIG. 2, and FIG. 3, the following takes a typical third-order smart magic cube as an example to describe a smart magic cube provided by the embodiments of the present disclosure in details. In one embodiment, the smart magic cube includes six faces, each of the six faces includes nine magic cubes, and the six faces include six central blocks 1, eight corner blocks 2 and twelve edge blocks 3, a total of 26 magic cubes. The smart magic cube further includes a ball shaft 4. The ball shaft 4 is located at a center position and act as a rotation center. In one embodiment, the central blocks 1 are arranged on a rotation axis of each face, and the central blocks 1 serve as the rotation center of each face of the smart magic cube, and a position of the central blocks 1 remains unchanged, and only one face has a color or a pattern. The edge block 3 is one magic cube embedded between any two central blocks 1, and the edge block 3 has two faces composed of different colors or patterns. Every adjacent three of the twelve edge blocks are connected by the corner blocks 2. An initial state of the smart magic cube is that each face has a different color, but a same face has the same color. Of course, each face can also be distinguished by setting different patterns. A gameplay of the smart magic cube is to scramble the magic cubes on each face, so that each face may contain different colors or patterns, and finally each face needs to be restored to corresponding original state.

As shown in FIG. 2, FIG. 3, FIG. 4, and FIG. 5, the smart magic cube of the present disclosure has made important improvements to a structure of the ball shaft. In one embodiment of the present disclosure, the ball shaft 4 includes a ball shaft housing 41, and the ball shaft housing 41 includes an upper half housing 411 and a lower half housing 412. The upper half housing 411 and the lower half housing 412 are detachably connected, for example, the upper half housing 411 and the lower half housing 412 are detachably connected by screws, buckles, etc. By a detachable connection between the upper half housing 411 and the lower half housing 412, a sensing device 5 can be built into a second accommodation space 44 formed inside the ball shaft housing 41.

Figure 4:
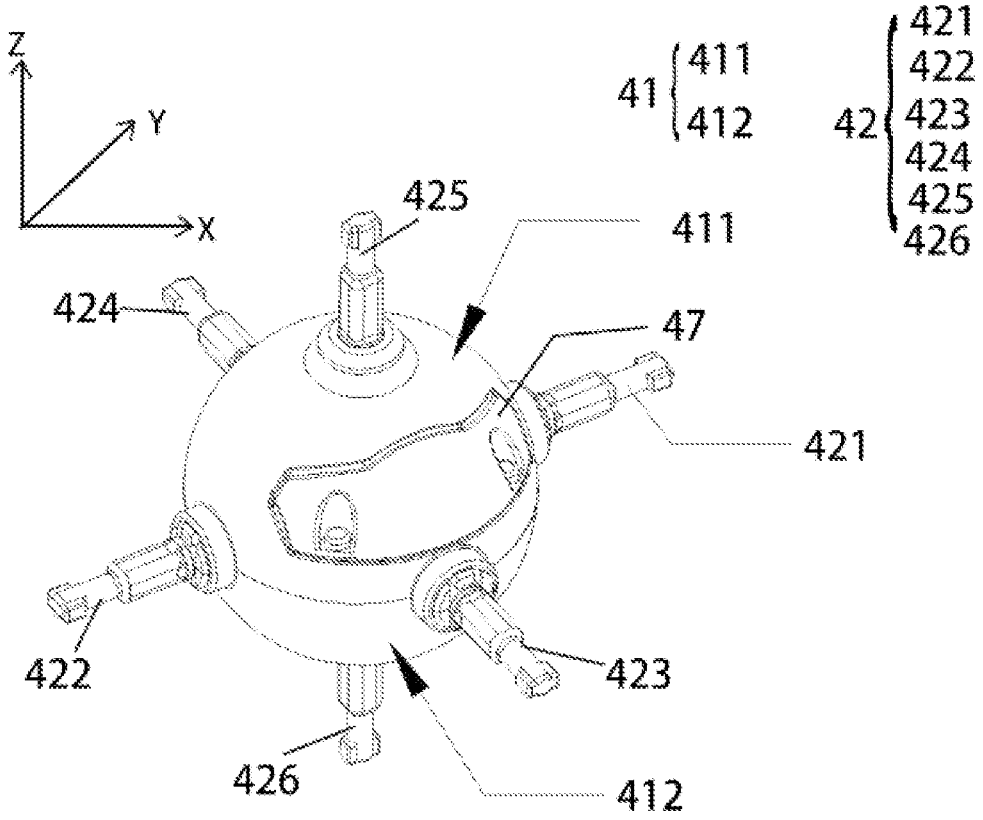
FIG. 4 is an overall structural schematic diagram of a ball shaft according to one embodiment of the present disclosure.

On the ball shaft housing 41, a three-dimensional coordinate system is built by setting a spherical center of the ball shaft housing 41 as an origin, as shown in FIG. 4 (FIG. 4 schematically moves the three-dimension coordinate system outside the ball shaft to avoid influence on various parts), setting a right rotating shaft 421 in a positive direction of an X-axis, setting a left rotating shaft 422 in a negative direction of the X-axis, setting a front rotating shaft 423 in a negative direction of a Y-axis, setting a rear rotating shaft 424 in a positive direction of the Y-axis, setting an upper rotating shaft 425 in a positive direction of a Z-axis, and setting a lower rotating shaft 426 in a negative direction of the Z-axis. A positioning module 54 is arranged on each of rotating shafts 42, and the positioning module 54 rotates with a corresponding rotating shaft 42. The second accommodation space 44 for accommodating the sensing device 5 is arranged inside the ball shaft housing 41. A battery compartment 45 is arranged in the second accommodation space 44, and a battery 46 can be arranged in the battery compartment 45. In one embodiment of the present disclosure, the battery 46 is a button battery, specifically a CR2032 button battery. The battery 46 can work for 10 hours, and a standby time of the battery can reach one year without using the smart magic cube, which can meet usage scenarios of the smart magic cube. A battery cover 47 is arranged on the upper half housing 411 of the ball shaft housing 41, and the battery cover 47 is detachably mounted on the upper half housing 411. By opening the battery cover 47, it is convenient and better to replace the battery 46.

Figure 5:
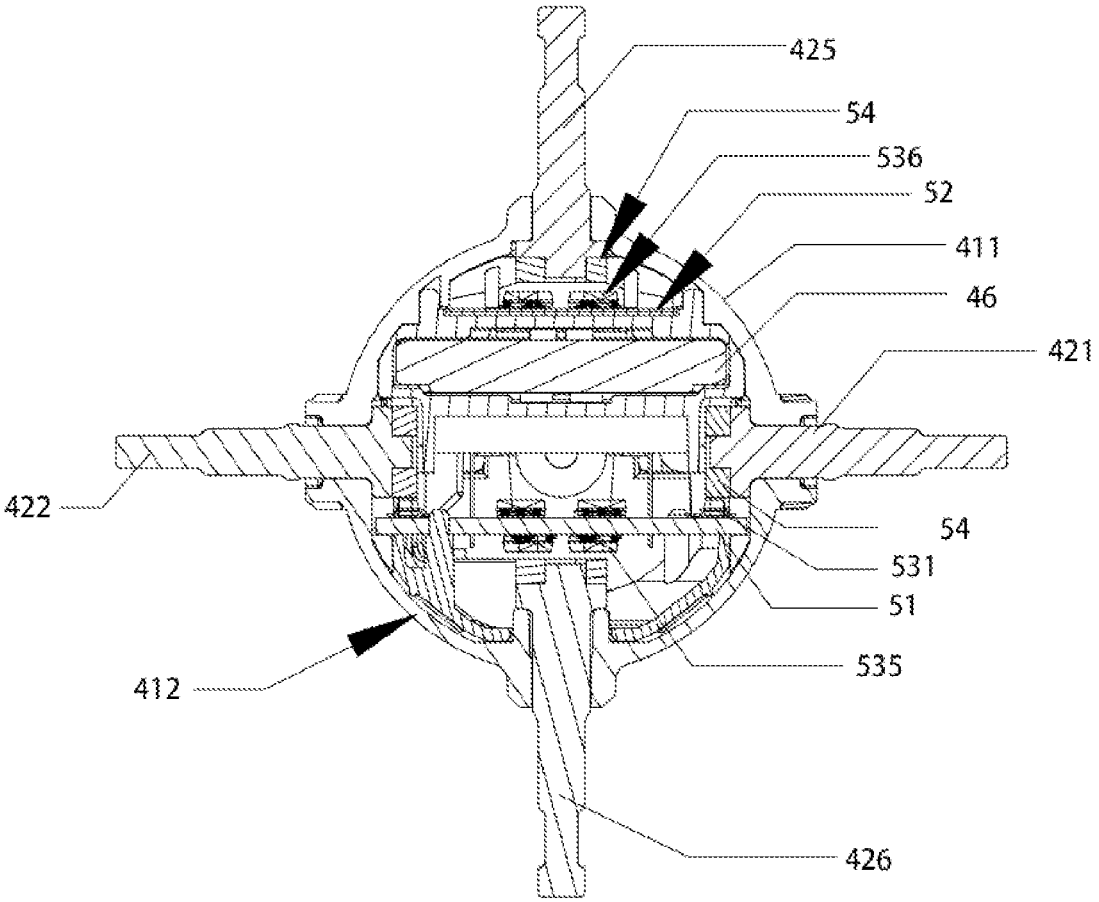
FIG. 5 is a sectional diagram of the ball shaft according to one embodiment of the present disclosure.
Figure 6:
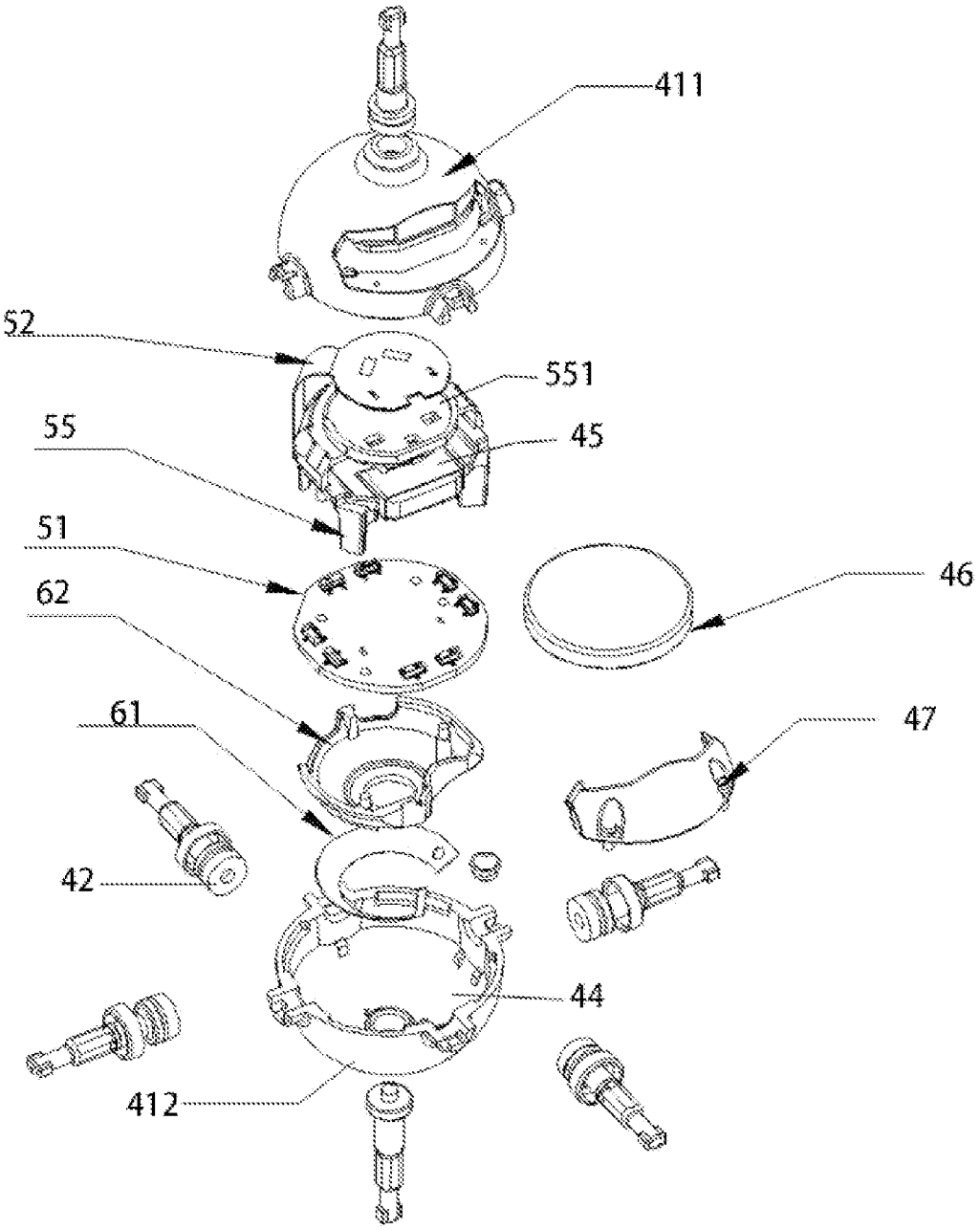
FIG. 6 is an exploded structural schematic diagram of the ball shaft according to one embodiment of the present disclosure.
Figure 7A:
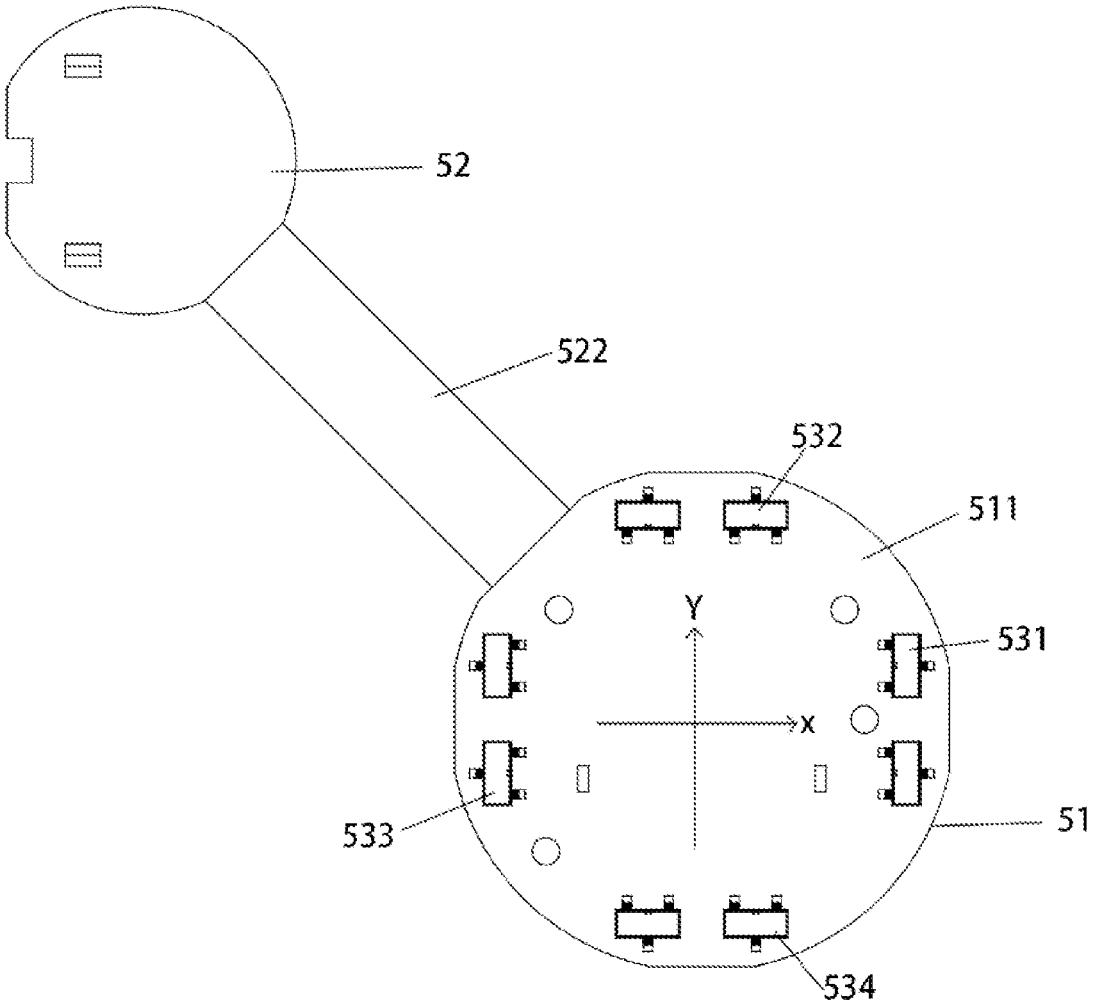
FIG. 7A is a structural schematic diagram of a sensing device according to a first embodiment of the present disclosure.
Figure 7B:
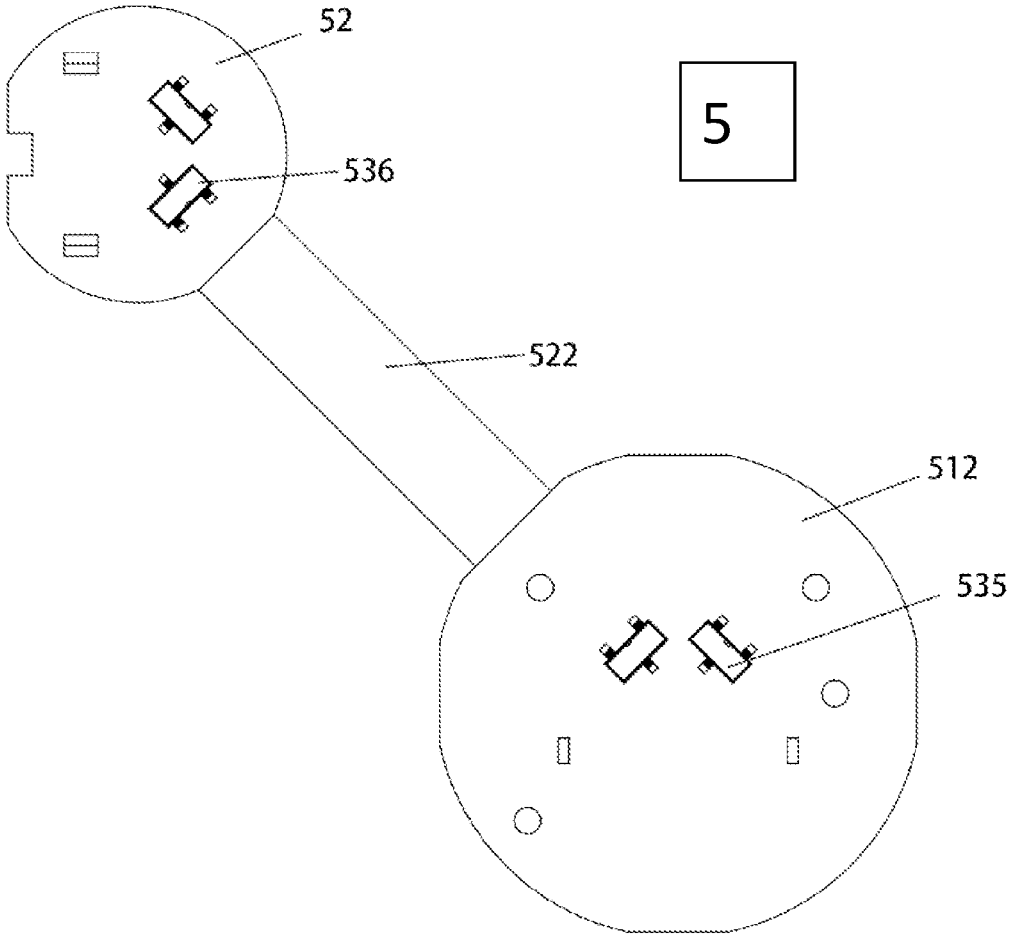
FIG. 7B is a structural schematic diagram of the sensing device according to a second embodiment of the present disclosure.
Figure 7C:
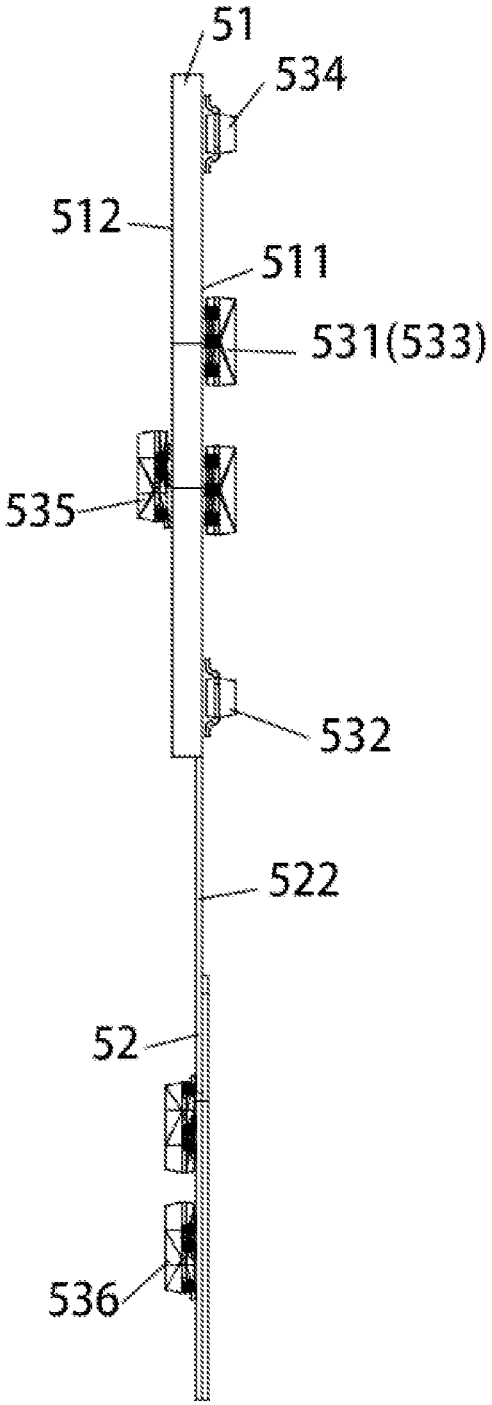
FIG. 7C is a structural schematic diagram of the sensing device according to a third embodiment of the present disclosure.

In one embodiment of the present disclosure, in each direction of the rotating shafts of the ball shaft housing 41, an installation hole of the rotating shaft is defined (as shown in FIG. 5 and FIG. 6). A lower half part of each of the rotating shafts 42 defines an insertion part, each of the rotating shafts is assembled with the ball shaft housing by inserting the insertion part into the installation hole. A connection mode between the insertion part and the ball shaft housing can be a buckle connection or a screw connection, which is not limited here. In one embodiment of the present disclosure, the installation hole with respect to the upper rotating shaft 425 is defined on the upper half housing 411, and the installation hole with respect to the lower rotating shaft 426 is defined on the lower half housing 412. The installation holes of the left rotating shaft 422, the right rotating shaft 421, the front rotating shaft 423, and the rear rotating shaft 424 are divided into two parts, one half of the two parts is arranged on the upper half housing 411, and the other half of the two parts is arranged on the lower half housing 412. The above setting structure achieves a more balanced in all directions on the whole, which is conducive to hold and operate the smart magic cube.

As shown in FIG. 5, FIG. 6, FIG. 7A, and FIG. 7B, in one embodiment of the present disclosure, the ball shaft for the smart magic cube includes a sensing device 5 arranged in the second accommodation space 44 inside the ball shaft housing 41. The sensing device 5 includes a master circuit board 51 and a slave circuit board 52. In one embodiment, the master circuit board 51 defines a micro control unit (not shown in the drawings), and the master circuit board 51 includes a first circuit board 511 and a second circuit board 512. The first circuit board 511 is arranged on a front side of the master circuit board 51, and the second circuit board 512 is arranged on a reverse side of the master circuit board 51. A plane rectangular coordinate system is built by setting a center of the first circuit board 511 as an origin, a positive direction of an X-axis as a first direction, a negative direction of the X-axis as a third direction, and a positive direction of a Y-axis as a second direction, and a negative direction of the Y-axis as a fourth direction. A first electronic sensing element 531, a second electronic sensing element 532, a third electronic sensing element 533, and a fourth electronic sensing element 534 are correspondingly arranged in each of the directions. A fifth electronic sensing element 535 is arranged in a central area of the second circuit board 512. Each of the electronic sensing elements is in communication connection with the micro control unit. The slave circuit board 52 is arranged on a preset plane parallel to the first circuit board 511, and the preset plane and the second circuit board 512 are separated on both sides of the first circuit board 511, and the slave circuit board 52 defines a sixth electronic sensing element 536, and the sixth electronic sensing element 536 is in communication connection with the micro control unit.

In one embodiment of the present disclosure, the sensing device 5 further includes a first positioning module, a second positioning module, a third positioning module, a fourth positioning module, a fifth positioning module, and a sixth positioning module respectively arranged on the six rotating shafts of the smart magic cube. Each of the electronic sensing elements is respectively inductively positioned with the positioning module 54 in corresponding direction. In one embodiment of the present disclosure, the electronic sensing element is a magnetic sensor, and the magnetic sensor, includes but is not limited to one of Hall elements, tunneling magnetoresistance (TMR), anisotropic magnetoresistance (AMR), giant magnetoresistance (GMR) or Various combinations. The positioning module 54 is a magnetic positioning module. In the sensing device of the present disclosure, the master circuit board is arranged on the ball shaft of the smart magic cube and located at the center of the smart magic cube. Therefore, the magnetic sensor as an electronic sensing element is also arranged at the center of the smart magic cube, and a magnetic positioning module is arranged on the rotating shaft. When the magnetic positioning module arranged on the rotating shaft, such as a magnet, rotates, a direction of the magnetic field on the magnet will also rotate as a whole. At this time, a relationship between the direction of the magnetic field and the magnetic sensor changes, which will cause an induced electromotive force of the magnetic sensor or an induced current of the magnetic sensor changes. A change of the induced electromotive force or the induced current is transmitted to the micro control unit, and the micro control unit can determine a rotation angle of the ball shaft according to the change and a trend of the induced electromotive force or the induced current.

Figure 8:
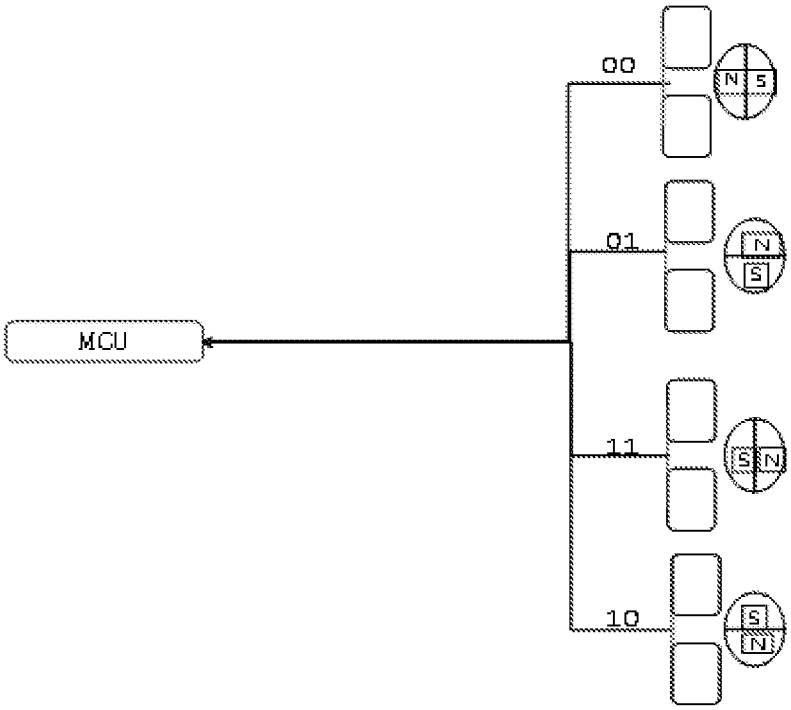
FIG. 8 is a schematic diagram of a connection state of a micro control unit, sensing elements, and magnetic positioning modules.
Figure 9:
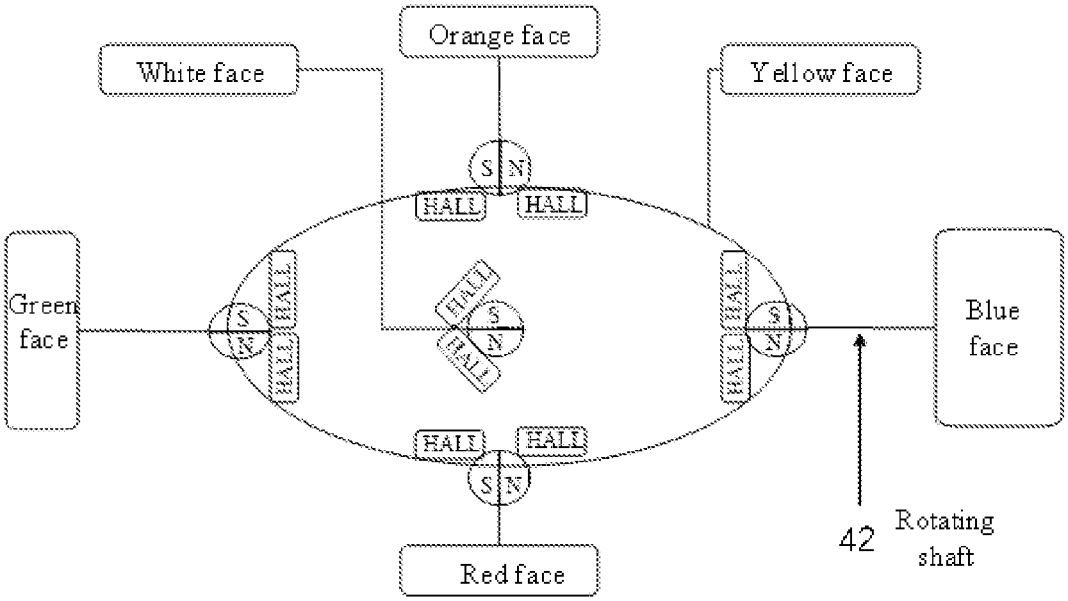
FIG. 9 is a schematic diagram of a corresponding connection between Hall sensors and magnets configured on each face of the smart magic cube.
Figure 10:
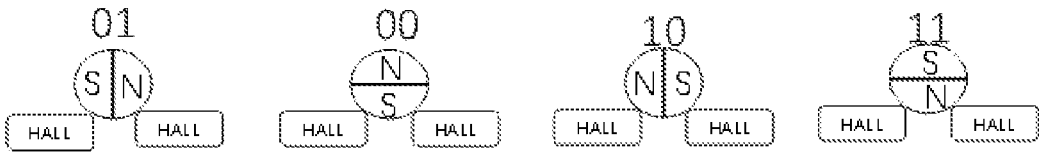
FIG. 10 is a schematic diagram of output values of the Hall sensors, taking one of faces of the smart magic cube rotating as an example to illustrate the output values.

As shown in FIG. 7A to FIG. 7C and FIG. 8 to FIG. 11, the embodiment of the present disclosure is described by taking the electronic sensing element as a Hall sensor as an example. As shown in FIG. 8 and FIG. 9, two Hall sensors are arranged on the circuit board with respect to each direction of the rotating shaft. In one embodiment, the Hall sensor with a yellow face is arranged on a back side of FIG. 9, and a setting position of the Hall sensor with the yellow face corresponds to a white face, and is arranged on the second circuit board of master circuit board 51, and the Hall sensor with the white face is arranged on the slave circuit board 52. Two Hall sensors respectively detect the magnetic field direction on the magnetic positioning module on corresponding rotating shafts, and generate the induced current or the induced electromotive force according to the detected magnetic field direction and send the induced current or the induced electromotive force to the micro control unit (MCU). Therefore, after determining an initial state of the two Hall sensors corresponding to each face (the initial state of the Hall sensor is that an APP obtains a corresponding relationship between the Hall sensor and the magnet and determines a value when the state of the smart magic cube is input into the APP), subsequent rotation of the faces of the magic cube rotates at 90 degrees. Every time one face of the magic cube drives the magnet to rotate 90 degrees, each Hall sensor will output a signal of 0 or 1 to the MCU. Then a signal combination of the two Hall sensors has a total of four combined signals (00, 01, 10, 11), which respectively represent four different magnetic field directions of the magnet. Therefore, the MCU obtains the rotation angle of the magic cube according to the signal combination received from a pair of Hall sensors on corresponding shaft, and updates the status of the magic cube. As shown in FIG. 10, when the initial state of one face of the magic cube corresponds to a Hall value of 01, the face of the magic face rotates 90 degrees Counterclockwise, and the Hall value is 00; the face of the magic face rotates 90 degrees Clockwise, the Hall value is 11; and the face of the magic face rotates 180 degrees, the Hall value is 10. In the above-mentioned embodiments, a binary switch-type Hall sensor is used as an example for illustration. The technical solution provided by the embodiment of the present disclosure can also use a linear Hall element. When a linear Hall element is used as an inductive electronic element, any rotation angle information can be obtained after an output signal is converted by an analog-to-digital conversion (ADC), not limited to 90 degrees.

Figure 11:
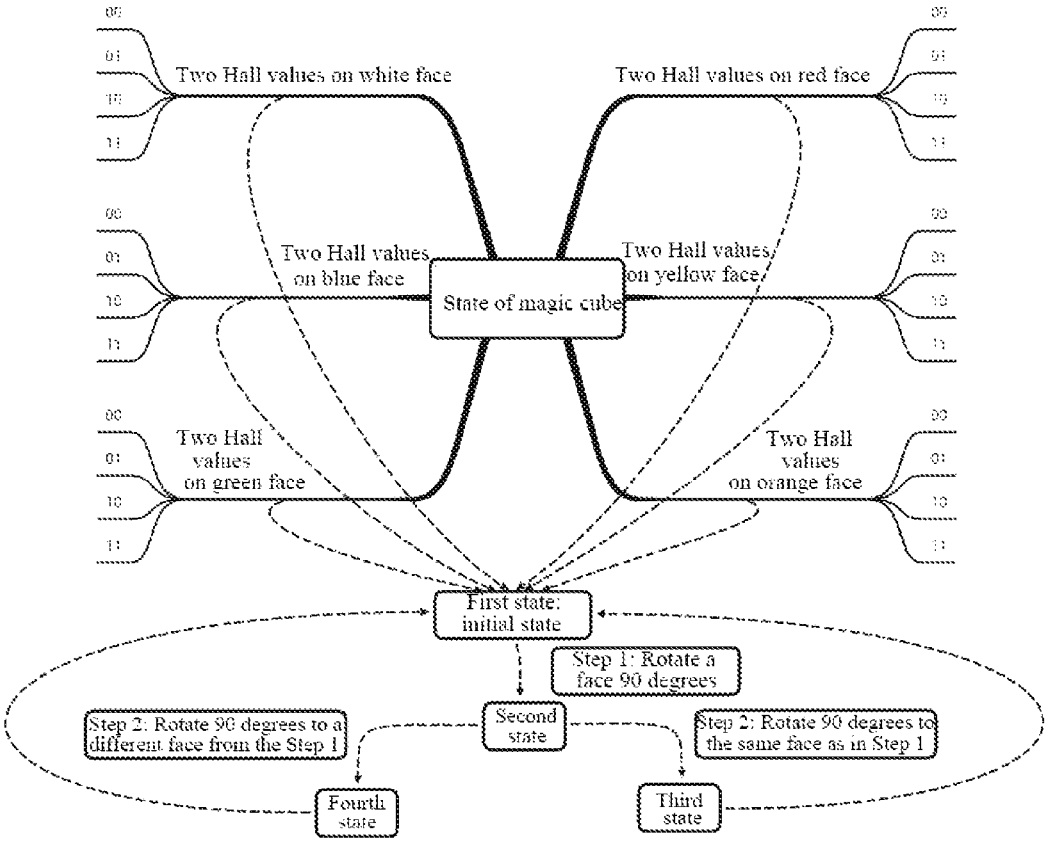
FIG. 11 is a schematic diagram of the rotation state of the smart magic cube and a working principle of the Hall sensors.

As shown in FIG. 11, when the initial state of each face of the magic cube is determined (that is, defined as a first state), according to a rotating face, the values of the two Hall sensors on corresponding face will change, for example when the white face rotates, a position relationship between the Hall sensor on the white face and the magnet on the corresponding face changes, and the Hall sensor on the white face generates a corresponding value and sends the value to the micro control unit. For the description of the position relationship between the value of the Hall sensor and the magnet, please refer to above description of FIG. 10. At this time, the state of the face of the magic cube corresponds to a second state.

When continuing to rotate the face of the magic cube, there will be following two situations.

When continuing to rotate the face rotated in above first step, which rotating single face 180 degrees, here is a single face rotation mechanism: in the initial state of the single face, assuming that corresponding Hall value is 01, and the single face can be rotated freely. When a Tps speed is greater than a Hall speed, the Hall sensor cannot capture how many 90 degrees of rotation. As long as a speed of the magic cube drops and when the MCU can capture the Hall value, according to FIG. 10, according to the Hall value of the magic cube, a position of the single face is reversely calculated, so that the status of the magic cube is synchronized, which is a third state.

A different face from above step is rotated 90 degrees. In this step, the face is rotated by 90 degrees based on a change of the two Hall values of the corresponding face, and then a rotation direction of is determined based on an initial Hall value of the face in the second state and FIG. 10, which is a fourth state.

After the third state and the fourth state are updated, the third state and the fourth state are used as a newly initial state, and the above steps are repeated according to the rotation of each face with respect to the newly initial state.

In one embodiment of the present disclosure, as shown in FIG. 7A to FIG. 7C and FIG. 12, the master circuit board 51 and the slave circuit board 52 are composed of a same flexible printed circuit (FPC) board integrally connected. The master circuit board 51 connects to the slave circuit board 52 by a reserved long strip connection structure 522. The master circuit board 51 and the slave circuit board 52 can be processed on the same FPC board. A first Hall sensor, a second Hall sensor, a third Hall sensor, and a fourth Hall sensor are arranged on the first circuit board 511 of the master circuit board 51, a fifth Hall sensor is arranged on the second circuit board 512, and another fifth Hall sensor is arranged on the slave circuit board 52 at the same time. Due to a flexibility of the FPC board, it is very convenient to change a position relationship between the master circuit board 51 and the slave circuit board 52, so that the master circuit board 51 and the slave circuit board 52 are able to be arranged at a preset position. The circuit connection between the master circuit board 51 and the slave circuit board 52 is realized by the long strip connection structure 522. Since the master circuit board 51 and the slave circuit board 52 are defined on the same FPC board, there is no need for any welding between the master circuit board 51 and the slave circuit board 52, which can reduce a welding process between different PCB boards in the prior art, and can effectively improve an assembly speed of the smart magic cube.

Figure 12:
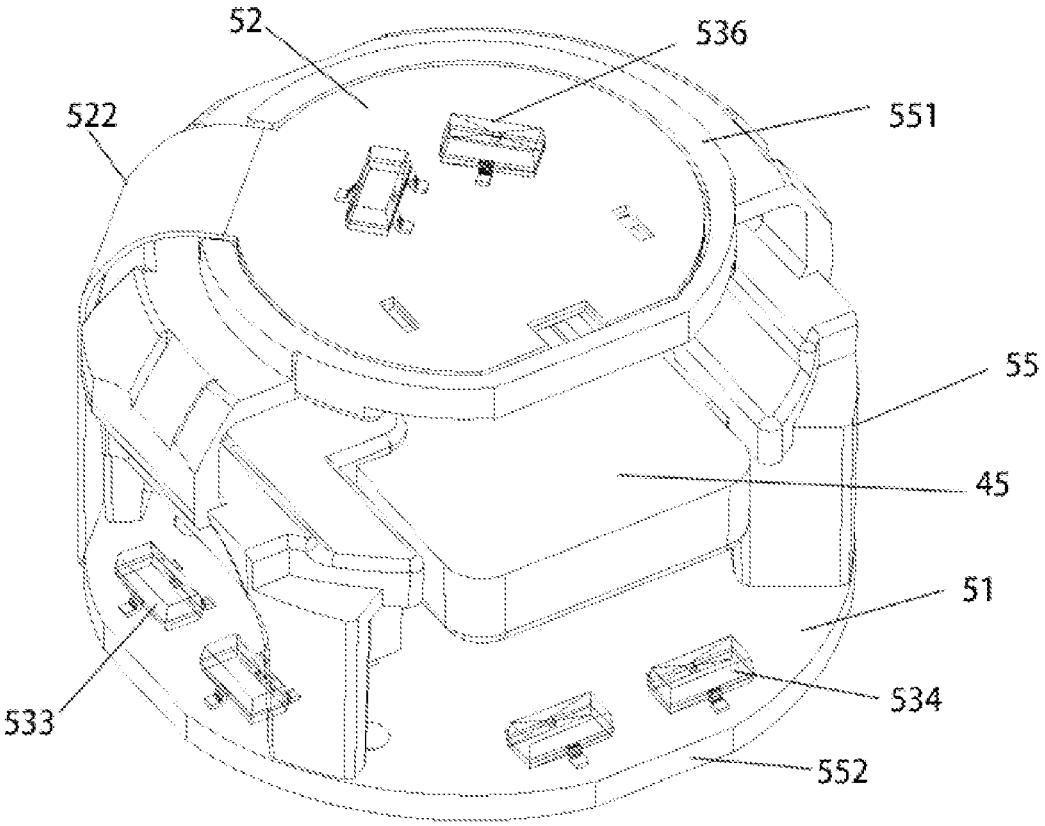
FIG. 12 is a structural schematic diagram of a circuit board fixing base combined with a circuit board according to one embodiment of the present disclosure.

In one embodiment, the same FPC board is configured to form the master circuit board 51 and the slave circuit board 52, a preferred embodiment of the present disclosure further defines a circuit board fixing base 55. As shown in FIG. 12, a first fixing platform 551 is arranged on a top of the circuit board fixing base 55, and a second fixing platform 552 is arranged at a bottom of the circuit board fixing base 55, and the first fixing platform 551 is parallel to the second fixing platform 552. A first accommodation space is defined between the first fixing platform 551 and the second fixing platform 552, and a first part of the first accommodation space close to the first fixing platform 551 defines the battery compartment 45 for accommodate the battery. A second part of the first accommodation space close to the second fixing platform part defines an electronic component accommodation bin for accommodating electronic inductive elements. A through hole or a blind hole for accommodating the fifth electronic sensing element is arranged in a middle of the second fixing platform 552, the master circuit board 51 is fixed on the second fixing platform 552, and the slave circuit board 52 is fixed on the first fixing platform 551. A number of hollow parts are arranged between the first fixing platform 551 and the second fixing platform 552. In a case of ensuring a structural strength of the circuit board fixing base 55, by setting a hollow structure, on the one hand, the sensing device can be reduced, that is, a total weight of the ball shaft can be reduced, and on the other hand, an internal air flow can also be strengthened, so that heat generated by the battery can be reduced, and the heat generated by the battery is transferred to an outside of the magic cube.

The biggest advantage of using the same FPC board to form the master circuit board 51 and the slave circuit board 52 is that the two circuit boards are the same circuit board, so that the circuit connection between the two circuit boards does not require any soldering work. Therefore, the process complexity can further be reduced to achieve a better assembly effect.

However, due to a fact that a price of FPC materials is relatively expensive at present, with a development of technology and material technology in the future, a solution of using FPC boards may become a mainstream trend, but there is still a problem of high cost at present. Therefore, this disclosure provides another embodiment.

In a second embodiment of the present disclosure, the master circuit board 51 adopts a hard PCB board, and the slave circuit board 52 adopts the FPC board. In the sensing device of the present disclosure, a main part is arranged on the master circuit board 51, and electronic induction element and the micro control unit are arranged on the master circuit board 51, therefore the main part adopts the PCB board with mature technology and relatively low price, and for the slave circuit board that needs to change a layout position and direction, the FPC board is configured as the slave circuit board. The PCB board and the FPC board are connected by the long strip connection structure, and a fixation and a circuit connection between the two circuit boards are realized by welding between the PCB board and the strip connection structure.

Correspondingly, the present disclosure also defines a corresponding circuit board fixing base in a second embodiment of the second circuit board, and a first fixing platform is arranged on the top of the circuit board fixing base. A first accommodation space is defined between the first fixing platform and a bottom of the circuit board fixing base, and a first part of the first accommodation space close the first fixing platform defines the battery compartment for accommodating batteries, and a second part of the first accommodation space close to the bottom of the circuit board fixing base defines an electronic component accommodation bin for accommodating the electronic inductive elements. The slave circuit board is fixed on the first fixing platform, and the master circuit board is fixed on the bottom of the circuit board fixing base, and the first fixing platform is parallel to the master circuit board. Compared with the circuit board fixing base of the first embodiment, the circuit board fixing base of the embodiment does not need to set a second fixing platform, because the PCB board is a straight hard board, which can fully withstand placement of various components on the PCB board and maintains a stable shape when the PCB board is fixed on the circuit board fixing base.

In another embodiment of the present disclosure, as shown in FIG. 6, under the circuit board fixing base 55, that is, at the bottom of the PCB board or the second fixing platform 552, an antenna fixing base 62 is defined. The antenna 61 is fixed on the antenna fixing base 62. The antenna fixing base 62 and the antenna 61 are integrally located inside the lower half housing 412. In this way, when an overall sensing device is located in the upper half housing, the antenna and the antenna fixing base can balance a structural relationship inside the ball shaft. In one embodiment, the antenna 61 is a Bluetooth antenna, and the antenna 61 is connected to the micro control unit circuit. For the smart magic cube of the present disclosure, the micro control unit is connected to an external terminal (such as a mobile phone, a tablet computer, a server) by the antenna 61, so that the external terminal can obtain rotation status data of the magic cube detected on the smart magic cube. At the same time, the external terminal can also send control commands to the micro control unit by the antenna 61.

The overall assembly process of the smart magic cube of the present disclosure is as follows. First, the micro control unit and each electronic induction unit are respectively arranged on the first circuit board 511, the second circuit board 512 of the master circuit board 51, and the slave circuit board 52 according to the design requirements. In this process, since not every face sets a PCB, it is no longer necessary to precisely adjust the vertical relationship between each circuit board, but a mature electronic component mounting process can be used, therefore not only a connection stability between various components is improved, but also the tedious work of deployment is reduced. At the same time, in the case that the master circuit board adopts the PCB board and the slave circuit board adopts the FPC board, the circuit connection between the boards is realized by welding. Then an assembled circuit board is arranged on the circuit board holder 55, and the overall installation and fixation of the sensing device is realized. The entire assembled sensing device, as well as other components such as the antenna 61 and the antenna base 62, are arranged on the upper half housing or the lower half housing, and then the upper half housing and the lower half housing are combined to form the ball shaft. The rotating shafts are arranged on the ball shaft, and finally each magic cube is arranged on each face according to design requirements, thus realizing the overall assembly of the smart magic cube.

A working principle of the smart magic cube of the present disclosure is as follows. When one face of the magic cube is rotated, the rotating shaft with respect to the face may be rotated, and the rotating shaft drives the magnet located in the rotating shaft to rotate, thus changing the magnetic field direction of the magnet. The change of the direction of the magnetic field may act on the corresponding Hall sensor to generate a corresponding change of current or electromotive force, and the change of the current or electromotive force is transmitted to the micro control unit, so that the control unit may obtain the rotation angle of the rotating shaft by the change of the current or electromotive force. The micro control unit is connected to the external terminal by the Bluetooth antenna, and sends the obtained rotation status of each face to the external terminal, and the micro control unit may accept the control commands sent by the external terminal by the antenna.

The technical features of the above-mentioned embodiments can be combined arbitrarily. To make the description concise, all possible combinations of the technical features in the above-mentioned embodiments are not described. However, as long as there is no contradiction in the combination of these technical features, should be considered as within the scope of the specification.

For those skilled in the art, various other corresponding changes and deformations can be made according to the technical solutions and the ideas described above, and all these changes and deformations should fall within the protection scope of the claims of the present disclosure.

What is claimed is:

1. A sensing device for smart magic cube, comprising:

a master circuit board; and a slave circuit board;

wherein the master circuit board defines a micro control unit, the master circuit board comprises a first circuit board and a second circuit board, the first circuit board is arranged on a front side of the master circuit board, and the second circuit board is arranged on a reverse side of the master circuit board; a plane rectangular coordinate system is built by setting a center of the first circuit board as an origin, setting a positive direction of an X-axis as a first direction, setting a negative direction of the X-axis as a third direction, setting a positive direction of a Y-axis as a second direction, and setting a negative direction of the Y-axis as a fourth direction; a first electronic sensing element, a second electronic sensing element, a third electronic sensing element, and a fourth electronic sensing element are correspondingly arranged in each of the first direction, the second direction, the third direction, and the fourth direction; a fifth electronic sensing element is arranged in a central area of the second circuit board; each of electronic sensing elements is in communication connection with the micro control unit; and the slave circuit board is arranged on a preset plane parallel to the first circuit board, wherein the preset plane and the second circuit board are separated on both sides of the first circuit board, the slave circuit board defines a sixth electronic sensing element, and the sixth electronic sensing element is in communication connection with the micro control unit.

2. The sensing device for smart magic cube as recited in claim 1, wherein the sensing device further comprises a first positioning module, a second positioning module, a third positioning module, a fourth positioning module, a fifth positioning module, and a sixth positioning module respectively arranged on six rotating shafts of a smart magic cube, the first electronic sensing element, the second electronic sensing element, the third electronic sensing element, the fifth electronic sensing element, and the sixth electronic sensing element are respectively inductively positioned with the first positioning module, the second positioning module, the third positioning module, the fourth positioning module, the fifth positioning module, and the sixth positioning module.

3. The sensing device for smart magic cube as recited in claim 1, wherein the master circuit board is a printed circuit board (PCB), and the slave circuit board is a flexible printed circuit (FPC) board, the FPC board defines a long strip connection structure, the master circuit board is in communication connection with the slave circuit board by the long strip connection structure.

4. The sensing device for smart magic cube as recited in claim 3, wherein the master circuit board and the slave circuit board are composed of a same FPC board integrally connected, the master circuit board electrically connects to the slave circuit board by the long strip connection structure.

5. The sensing device for smart magic cube as recited in claim 1, wherein the sensing device further comprises a circuit board fixing base, and a first fixing platform is arranged on a top of the circuit board fixing base; a first accommodation space is defined between the first fixing platform and a bottom of the circuit board fixing base, and a first part of the first accommodation space close to the first fixing platform defines a battery compartment for accommodating a battery, and a second part of the first accommodation space close to the bottom of the circuit board fixing base defines an electronic component accommodation bin for accommodating electronic inductive elements; the slave circuit board is fixed on the first fixing platform; the master circuit board is fixed at a bottom of the circuit board fixing base, and the first fixing platform is parallel to the master circuit board.

6. The sensing device for smart magic cube as recited in claim 1, wherein the sensing device further comprises a circuit board fixing base, a first fixing platform is arranged on a top of the circuit board fixing base, and a second fixing platform is arranged at a bottom of the circuit board fixing base, and the first fixing platform is parallel to the second fixing platform; a first accommodation space is defined between the first fixing platform and the second fixing platform, and a first part of the first accommodation space close to the first fixing platform defines a battery compartment for accommodating a battery, and a second part of the first accommodation space close to the second fixing platform part defines an electronic component accommodation bin for accommodating electronic inductive elements; a through hole or a blind hole for accommodating the fifth electronic sensing element is arranged in a middle of the second fixing platform, the master circuit board is fixed on the second fixing platform, and the slave circuit board is fixed on the first fixing platform.

7. A ball shaft for smart magic cube, comprising:

the sensing device as recited in claim 1;

a spherical center of the ball shaft housing as an origin of a three-dimensional coordinate system;

a second accommodation space arranged inside the ball shaft housing for accommodating the sensing device;

a right rotating shaft arranged in a positive direction of a first X-axis;

a left rotating shaft arranged in a negative direction of the first X-axis;

a front rotating shaft arranged in a negative direction of a first Y-axis;

a rear rotating shaft arranged in a positive direction of the first Y-axis;

an upper rotating shaft arranged in a positive direction of a first Z-axis;

a lower rotating shaft arranged in a negative direction of the first Z-axis;

a positioning module arranged on each of rotating shafts;

a battery; and a wireless communication module;

wherein the first electronic sensing element corresponds to the right rotating shaft, the second electronic sensing element corresponds to the rear rotating shaft, the third electronic sensing element corresponds to the left rotating shaft, the fourth electronic sensing element corresponds to the front rotating shaft, the fifth electronic sensing element corresponds to the lower rotating shaft, and the sixth electronic sensing element corresponds to the upper rotating shaft;

the battery is arranged in a battery compartment;

the wireless communication module is in communication connection with the micro control unit, wherein the micro control unit is in communication connection with an external terminal by the wireless communication module.

8. The ball shaft for smart magic cube as recited in claim 7, wherein the sensing device further comprises a circuit board fixing base, a first fixing platform is arranged on a top of the circuit board fixing base, and a second fixing platform is arranged at a bottom of the circuit board fixing base, and the first fixing platform is parallel to the second fixing platform; a first accommodation space is defined between the first fixing platform and the second fixing platform, and a first part of the first accommodation space close to the first fixing platform defines a battery compartment for accommodating a battery, a second part of the first accommodation space close to the second fixing platform part defines an electronic component accommodation bin for accommodating electronic inductive elements, a through hole or a blind hole for accommodating the fifth electronic sensing element is arranged in a middle of the second fixing platform, the master circuit board is fixed on the second fixing platform, and the slave circuit board is fixed on the first fixing platform.

9. The ball shaft for smart magic cube as recited in claim 8, wherein an installation hole of each of the rotating shafts is defined in each direction of the rotating shafts of the ball shaft housing, a lower half part of each of the rotating shafts defines an insertion part, each of the rotating shafts is assembled with the ball shaft housing by inserting the insertion part into the installation hole, the insertion part defines a third accommodation space, and the third accommodation space is configured to accommodate the positioning module.

10. The ball shaft for smart magic cube as recited in claim 7, wherein the ball shaft housing defines a battery access port with respect to the battery compartment, and a battery cover is arranged on the battery access port, the battery cover is detachably connected to the ball shaft housing.

11. A smart magic cube, comprising:

the ball shaft as recited in claim 7;

six central blocks;

eight corner blocks; and twelve edge blocks;

wherein each of the rotating shafts defines one of the center blocks, one of the twelve edge blocks is arranged between every adjacent two of the central blocks, and one of the eight corner blocks is arranged between every adjacent three of the twelve edge blocks.

12. The smart magic cube as recited in claim 11, wherein the sensing device further comprises a circuit board fixing base, a first fixing platform is arranged on a top of the circuit board fixing base, and a second fixing platform is arranged at a bottom of the circuit board fixing base, and the first fixing platform is parallel to the second fixing platform; a first accommodation space is defined between the first fixing platform and the second fixing platform, and a first part of the first accommodation space close to the first fixing platform defines a battery compartment for accommodating a battery, a second part of the first accommodation space close to the second fixing platform part defines an electronic component accommodation bin for accommodating electronic inductive elements, a through hole or a blind hole for accommodating the fifth electronic sensing element is arranged in a middle of the second fixing platform, the master circuit board is fixed on the second fixing platform, and the slave circuit board is fixed on the first fixing platform.

13. The smart magic cube as recited in claim 12, wherein the ball shaft housing defines a battery access port with respect to the battery compartment, and a battery cover is arranged on the battery access port, the battery cover is detachably connected to the ball shaft housing.

14. The smart magic cube as recited in claim 11, wherein an installation hole of each of the rotating shafts is defined in each direction of the rotating shafts of the ball shaft housing, a lower half part of each of the rotating shafts defines an insertion part, each of the rotating shafts is assembled with the ball shaft housing by inserting the insertion part into the installation hole, the insertion part defines a third accommodation space, and the third accommodation space is configured to accommodate the positioning module.

* * * * *